US005495701A

United States Patent [19]

Poteat et al.

[11] Patent Number: 5,495,701

[45] Date of Patent: Mar. 5, 1996

[54] CLIP ATTACHMENT MECHANISM FOR FASTENING A SINGLE CLIP OR TWO CLIPS SIMULTANEOUSLY

[75] Inventors: William M. Poteat, Cary; Thomas E. Whittlesey, Apex; Kim L. Poling, Fuquay Varina; Edward P. Brinson; Bryan E. Wilkins, both of Raleigh, all of N.C.

[73] Assignee: Delaware Capital Formation, Inc., Apex, N.C.

[21] Appl. No.: 150,689

[22] Filed: Nov. 10, 1993

[51] Int. Cl.[6] ..... B65B 51/04

[52] U.S. Cl. ..... 53/138.2; 53/138.4; 29/243.57

[58] Field of Search ..... 29/33.5, 243.56, 29/243.57; 53/138.1, 138.2, 138.3, 138.4

[56] References Cited

U.S. PATENT DOCUMENTS

| | | | |
|---|---|---|---|
| 3,368,322 | 2/1968 | Yasui | 53/138.4 |
| 3,383,754 | 5/1968 | Klenz | 53/138.2 |
| 3,543,378 | 12/1970 | Klenz | 29/243.57 |
| 3,783,583 | 1/1974 | Dobbert | 53/138.2 |
| 4,571,805 | 2/1986 | Niedecker | 53/138.4 |
| 4,766,713 | 8/1988 | Evans | 53/138.4 |
| 5,077,955 | 1/1992 | Evans | 29/243.57 |
| 5,109,648 | 5/1992 | Evans | 53/138.2 |

*Primary Examiner*—W. Donald Bray
*Attorney, Agent, or Firm*—Banner & Allegretti, Ltd.

[57] ABSTRACT

A clipper apparatus is provided which is convertible between single and dual punch operation and includes a single pneumatic cylinder for driving both punches. One of the punches is driven directly by the cylinder. The second punch is connected to the first punch by means of a pin and key assembly which enables coupling or decoupling of the second punch to the first punch. Thereby the punches can be made to operate simultaneously. Alternatively, only the first punch will be driven by the pneumatic cylinder.

12 Claims, 4 Drawing Sheets

CLIP ATTACHMENT MECHANISM FOR FASTENING A SINGLE CLIP OR TWO CLIPS SIMULTANEOUSLY

BACKGROUND OF THE INVENTION

This invention relates to an improvement for a apparatus for attaching generally U-shaped clips about gathered materials.

Various prior art patents disclose the attachment of U-shaped metal clips about gathered casing material. For example, U.S. Pat. No. 4,766,713 discloses an apparatus for the attachment of two closely adjacent U-shaped metal clips about gathered casing material. Attachment of the two clips simultaneously to the gathered casing material may be followed by severing of the short linkage between the clips, making it possible to utilize a continuous length of casing to produce individual chubs filled with food products, for example, at high speed.

On occasion, however, it is not desirable to attach two clips simultaneously about the casing. For example, when multiple chubs are to remain connected during subsequent processing operations, only one clip is desired, solely to maintain a separation of the chubs being processed. Thus, utilization of a double clipper mechanism of the type shown in U.S. Pat. No. 4,766,713, incorporated by reference, and other patents referenced therein, would require modification of the equipment attaching the clips. Such modification could be time consuming and expensive. Continuing to use or attach two clips simultaneously would constitute clip wastage. Thus there has developed a need to provide a means for converting a double clipper apparatus into a configuration where only a single clip need be applied and vice versa. The present invention constitutes one apparatus for accomplishing such objectives.

SUMMARY OF THE INVENTION

Briefly, the present invention comprises an improvement in apparatus of the type normally utilized or normally designated as a double clipper. A double clipper is a clipper which is utilized to attach a pair of parallel, closely spaced U-shaped metal clips simultaneously about gathered material. Typically such an apparatus includes two parallel punches operated by a single fluid driven (usually pneumatic) cylinder. The cylinder is mounted on a support or body and connected directly to both of the punches which reciprocate in parallel channels. Clips are simultaneously fed into the channels and directed by the punches about gathered material and into contact with anvils which form the clips about the gathered material and seals the clips about that gathered material.

With the present invention, a single pneumatic or fluid driven cylinder is directly connected to a first punch which reciprocates in a first clip channel for engagement of a first clip in that channel against a first anvil to form the clip about gathered material adjacent the anvil in the pathway of the clip. A punch block is provided on the first with a through passage for the second punch. The second punch may pass through the passage and engage a clip in the second channel. The second punch includes a block engaging pin. A reciprocal catch mounted on the body of the clipper is positionable in two positions. In a first position, the catch will engage the pin associated with the second punch, thereby locking the second punch to the body so that the second punch is in an inoperative position. Means are provided to reciprocate the catch so that the second punch may be engaged or disengaged from the body. A key is mounted to the punch block in a passage transverse to the through passage in the block. The key is movable behind the second punch when the catch is in the second, non-engaging position and the pin is in a slot in the block. When behind the second punch, the key locks the second punch to the block and thereby the first punch.

In this manner the clipper may be converted between a single punch or dual punch mechanism. Thus, a single fluid driven cylinder coacting with a first punch rigidly and directly driven thereby will be convertible to a dual punch in the event the pin is in the block slot and the second punch is engaged by an appropriate key while disengaged from a catch.

Thus it is an object of the invention to provide apparatus which will enable conversion of a clipper from a single punch to a dual punch apparatus.

It is a further object of the invention to provide a clipper operable by a single fluid driven cylinder and convertible between a single punch and a dual punch apparatus.

It is a further object of the invention to provide a mechanically straightforward and mechanically reliable construction which enables conversion of a clipper between a dual punch and a single punch apparatus.

Yet another object of the invention is to provide a convertible clipper mechanism which enables conversion between a single punch operation and a dual punch operation which is economical, reliable, easy to effect conversion and mechanically simple.

These and other objects, advantages and features of the invention will be set forth in the detailed description which follows.

BRIEF DESCRIPTION OF THE DRAWING

In the detailed description which follows reference will be made to the drawing comprised of the following figures.

DESCRIPTION OF THE PREFERRED EMBODIMENT

Figure 1:
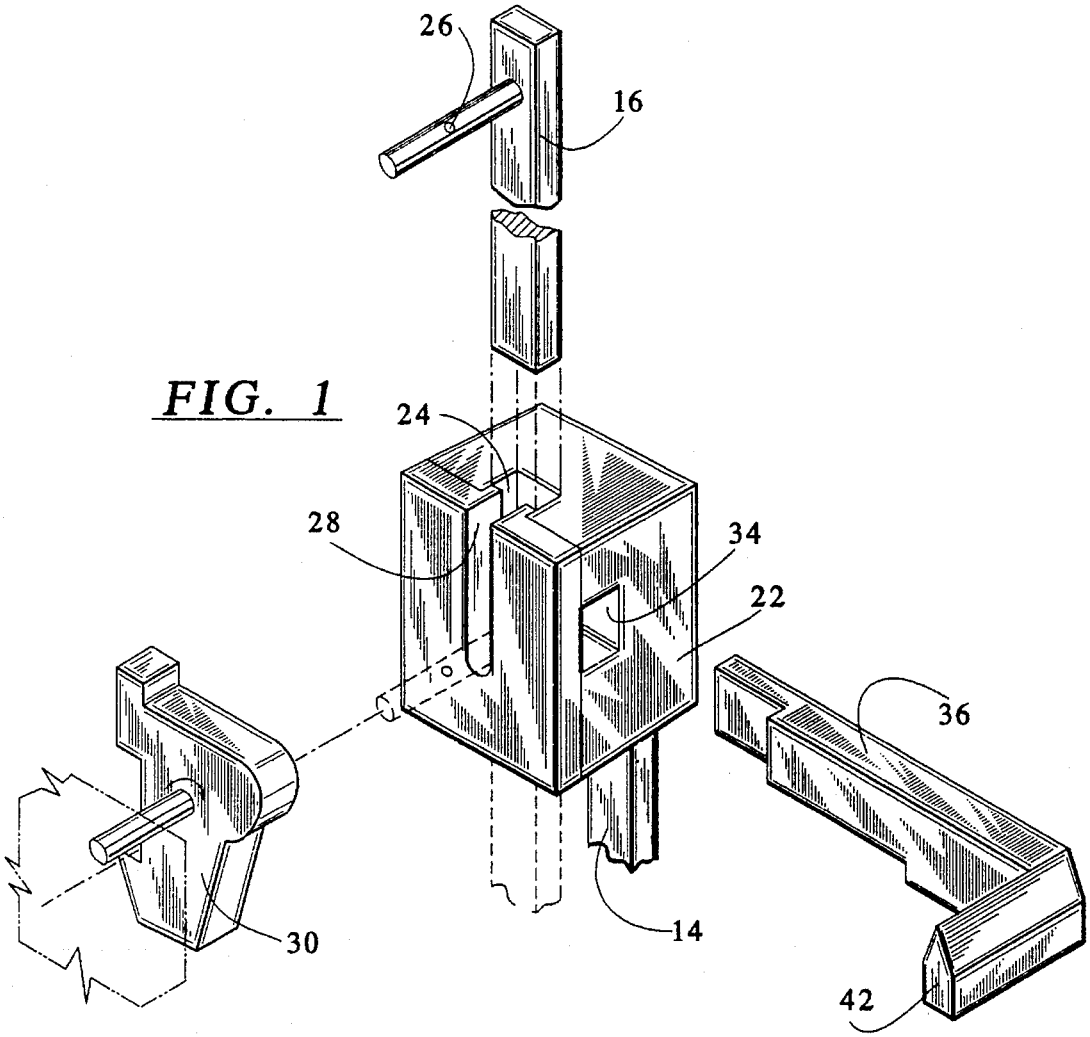
FIG. 1 is an exploded perspective and schematic view of portions of the mechanism associated with the conversion of the clipper between a single and a dual clip attachment apparatus.

Referring to FIGS. 1–4, the preferred mechanism of the invention is intended for and a part of apparatus 5 for attachment of generally U-shaped metal clips 6 (see FIG. 4) about gathered material (not shown). The apparatus comprises a body 7 defining a first clip channel 8 in the body and a second clip channel 9 in the body substantially parallel to the first clip channel 8. A clip feed means with outlets 10, 11 (see FIG. 4) feeds clips seriatim into the first clip channel 8, and, when activated to do so, into the second clip channel 9.

A first anvil 12 is supported by the body 7 at one end of the first clip channel 8. The anvil 12 forms each clip driven in the first clip channel 8 about material (not shown) which has been gathered adjacent the anvil 12 in the pathway of the clip driven in the first clip channel 8. A second anvil 13 is also supported by the body 7, at one end of the second channel 9. As with the first anvil 12, the second anvil 13 forms each clip driven in the second channel 9 about material (not shown) gathered adjacent the second anvil 13 in the pathway of the clip driven in the second channel 9.

A first punch 14 is reciprocally mounted in the first clip channel 8 and is movable in the first clip channel 8 for engaging and driving clips in the first clip channel 8. A second punch 16 is also reciprocally mounted, in the second clip channel 9, and is movable therein for engaging and driving clips in the second clip channel 9. Both punches 14, 16 are elongated steel members. The punches 14, 16 are reciprocated by a fluid drive member such as a pneumatic cylinder 18, which is supported (not shown) on the body 7. As shown, the cylinder 12 is connected to the first punch 14, in that the piston 20 of the cylinder 18 is attached to a punch block 22, and the block 22 is attached to the first punch 14. The punch block 22 is also steel. The piston 20 is also selectively connected to the second punch 16, as will be described. Motion of the pneumatic cylinder 18 and the clip feeding means is coordinated, such that individual clips enter the clip channels just ahead of the punches 14, 16 as the punches move toward the anvils 12, 13. Upon completion of formation of clips against the anvils 12, 13 under force of the punches 14, 16, the cylinder 18 retracts the punches 14, 16. Reciprocation of the punches 14, 16 is repeated as often as clips are to be formed.

For orientation in relation to further description, the axis defined by the length of the first punch 14 is the longitudinal axis. Transverse directions are those directions perpendicular to the longitudinal axis. The direction along the axis in which the punches move toward the dies is the direction of primary punch motion.

Figure 4:
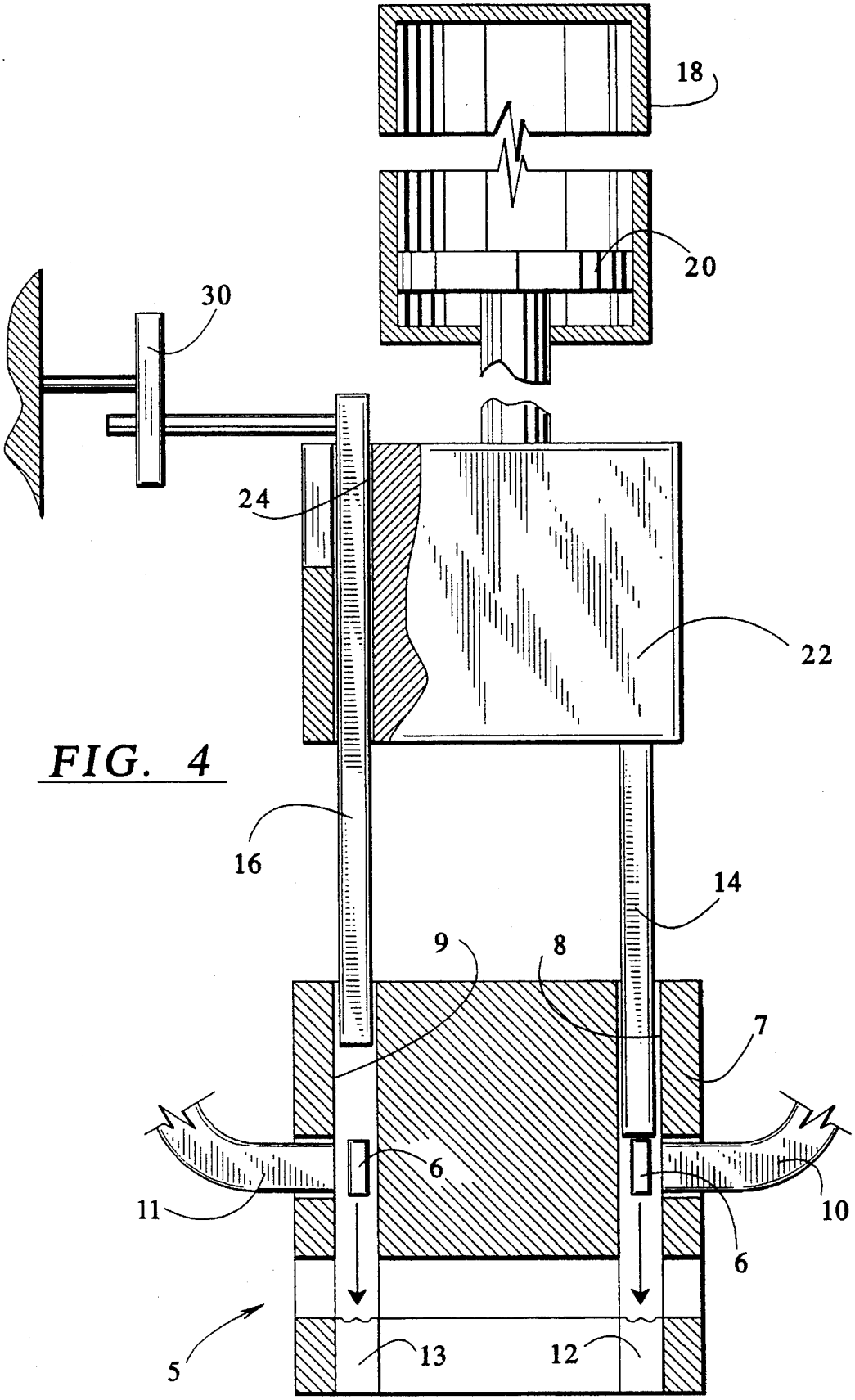
FIG. 4 is a section view of the invented mechanism and the clipper taken along line 4—4 of FIG. 2.

Referring to FIG. 4 and also to FIG. 1, the punch block member 22 defines a through passage 24 for the second punch 16. The through passage 24 extends through the block member 22 in the longitudinal direction, as best shown in FIG. 4. As shown in FIG. 1, the punch 16 is movable longitudinally and freely through the passage 24, to the limit of contact of a pin 26 (to be described) against a slot 28 (also to be described).

Figure 2:
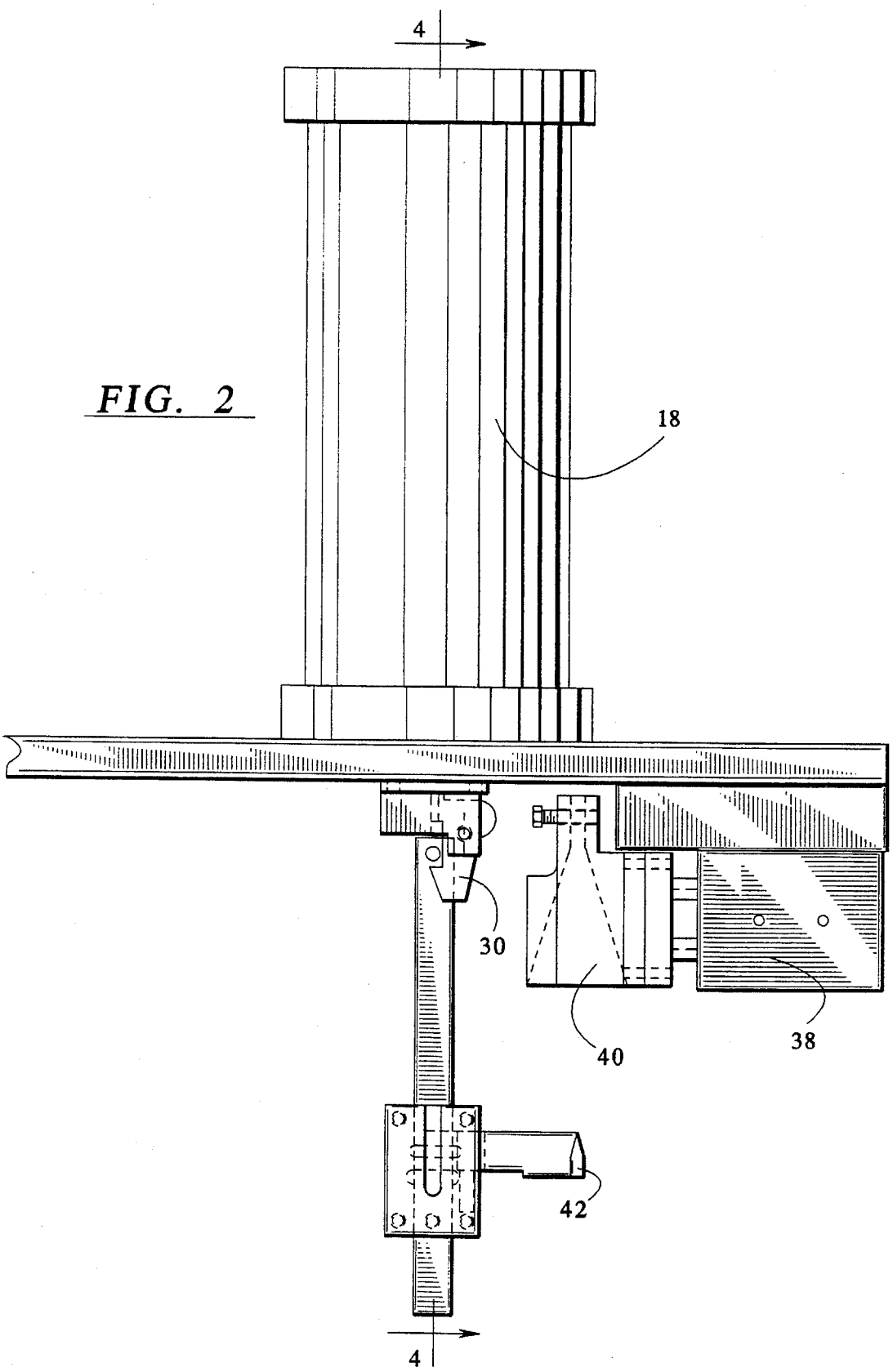
FIG. 2 is a side elevation of the clipper of the invention, with the preferred embodiment of the invented mechanism shown with the catch, key and actuator of the mechanism in positions such that the second punch is in an inoperative position.
Figure 3:
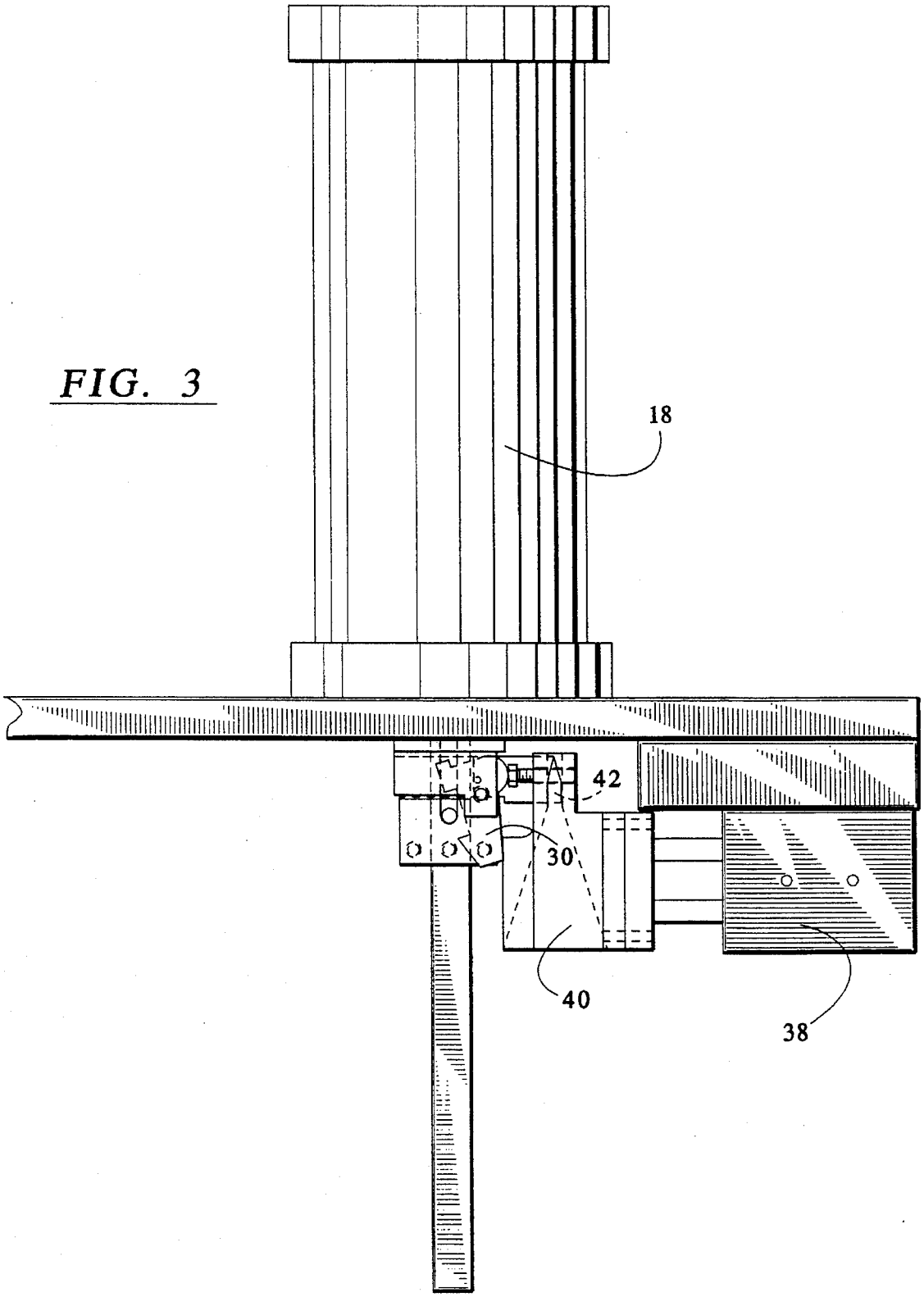
FIG. 3 is a side elevation view similar to FIG. 2, but with the catch, key and actuator of the mechanism shown such that the second punch of the clipper is in its operative position.

A catch 30 is mounted on the body, and is pivotal between a retaining-pin-engaging position, as in FIG. 2, and a second, non-engaging position, as in FIG. 3. The pin 26 is a post extending transversely a short distance from the intermediate portion of the second punch 16. In the first, retaining-pin-engaging position of the catch 30, the catch 30 hooks around the pin 26, on the side of the pin facing the direction of primary punch motion, and physically engages the pin 26. Movement of the pin 26, and thereby the punch 16, in the direction of primary punch motion, is inhibited and prevented. In the second, non-engaging position of the catch 30, the catch 30 does not engage the pin 26, and instead remains free of the catch 30. In this position of the catch 30, the pin 26 and the second punch 16 are not inhibited against longitudinal movement by the catch 30.

The punch block member 22 includes the retaining pin slot 28, which extends transversely into the through passage 24. An end 32 of the slot 28 is defined by the punch block sidewall, which limits and ends the slot longitudinally, in the direction of primary punch motion. The pin 26 and slot 28 are constructed and arranged such that the pin 26 fits in the slot 28 against the slot end 32 when the second punch 16 is moved longitudinally from engagement by the catch 24 into position to function as a punch in the second clip channel 9 and against the second anvil 13. The slot end limits free movement of the pin 26 in the manner described.

The punch block 22 also defines and includes a transverse, key passage 34 which extends into and is thereby connected to the through passage 24.

A second punch engaging key 36 is mounted to be slidable in the transverse key passage 34. The key 36 is slidable between a first position in which movement of the second punch in the through passage is limited and prevented, as in FIG. 3, and a second position of non-interference with the through passage, as in FIG. 2. (Note the reversal of first and second position designations of the catch 30 and key 36 as between FIGS. 2 and 3. In FIG. 2, the catch 30 is in a first position; the key is in the second position. In FIG. 3, the catch 30 is in the second position; the key is in the first position.) The key 36 is mounted in the passage 34 and thereby in the punch block 22. Because the punch block 22 moves with the first punch 14, in longitudinal reciprocation, the key 36 also moves in such reciprocation.

A linear actuator 38 in the form of a second pneumatic cylinder is mounted on the body, adjacent the catch 30. The punch block 22, and its key 36 are positioned longitudinally along the first punch 14 such that in the retracted position of the punch 14, the linear actuator 38 is, in the transverse direction, in line with the key 36 for the purpose of acting on the key 36. The actuator 38 moves transversely. When the key 36 is aligned with the actuator 38 because the first punch 14 is retracted, the linear actuator 38 is capable of sliding the key 36 between the first position of the key 36 and the second position of the key 36. The actuator 38 is also capable at all positions of the punch 14 of pivoting the catch 30 between its non-engaged position and its engaged position.

A guiding member 40 for receipt of the key 36 is located on the linear actuator 38. A guided member 42 is on the key 36. The guiding member 40 includes a funnel or cone shaped guide for alignment of the key 36 into contact with the linear actuator 38. As the first punch 14 and the punch block 22 move away from the direction of primary punch motion, i.e., the direction of retraction, the guided member 42 docks against and into the guiding member 40. Thus, the guided member 42 becomes docked on retraction, and is guided by the key 36 while docked, for transverse motion.

Both punches 14, 16 operate simultaneously when the key 36 is in the first position limiting movement of the second punch relative to the punch block member 22 and the catch 30 is in the non-engaged position. The first punch 14 operates and the second punch 16 is inoperative when the key 36 is in the second position and the catch 30 is in the engaged position. The positions of the catch 30 and key 36 are under control of the linear actuator 38. Remote control of the actuator 38 provides change to a single punch or a double punch at will.

The preferred embodiment of the invention, and the invention, are now described in such full, clear, concise and exact terms as to allow a person of ordinary skill in the art to make and use the same. To particularly point out and distinctly claim the subject matter regarded as invention, the following claims conclude this specification. In the claims, the singular includes the plural unless necessary to preserve claim validity.

What is claimed is:

1. In apparatus for attachment of generally U-shaped metal clips about gathered material, said apparatus including a body, a first clip channel in the body, means for feeding a clip into the first channel, an anvil supported by the body at one end of the first channel for forming a clip driven in the first channel about gathered material adjacent the anvil in the pathway of the clip driven in the first channel, a first punch reciprocally mounted in the first channel and movable therein for engaging and driving a clip in the first channel, and fluid drive means supported on the body and connected to the first punch for driving the first punch in the first channel, the improvement comprising, in combination:

a second punch parallel to the first punch, means on the body defining a second clip channel parallel to the first clip channel, and a second anvil; and means for releasably attaching the first punch to the second punch for movement therewith and for coaction with a second U-shaped metal clip driven in the second clip channel against the second anvil to thereby attach substantially simultaneously a first clip and a second clip about gathered material adjacent the respective anvils in the pathway of clips in each of the respective channels, said means for releasable attaching including (a) a block member having a through passage for the second punch, the block member connected to the first punch, the second punch including a punch retaining pin, (b) a catch mounted on the body, pivotal between a retaining pin engaging position and a second non-engaging position;

(c) said block member further including a retaining pin slot opening into the through passage, the slot defining an end in the direction of punch travel to engage the pin and limit free movement of the pin therethrough the slot, (d) said block further including a transverse passage extending into the through passage, (e) a second punch engaging key slidable in the transverse passage between a first position limiting movement of the second punch in the through passage, and a second position of non-interference with the through passage; and (f) means for sliding the key between the first position and the second position and for pivoting the catch between non-engaged position and the engaged position, to thereby operate both punches simultaneously when the key is in the first position limiting movement of the second punch relative to the block member and the catch is in the non-engaged position.

2. In apparatus for attachment of fasteners to workpieces, said apparatus including a body, a first fastener pathway in the body, means for feeding a fastener into the first fastener pathway, an anvil supported by the body at one end of the first fastener pathway for forming a fastener driven in the first fastener pathway to attach the fastener to a workpiece located adjacent the anvil in the first fastener pathway, a first punch means mounted to the body for movement for engaging and driving a fastener along the first fastener pathway, and drive means supported on the body and connected to the first punch means for driving the first punch, the improvement comprising, in combination:

a second punch means substantially parallel to the first punch means; means on the body defining a second fastener pathway; and a second anvil; and means for connecting and releasing the second punch means to and from the first punch means, for simultaneous movement of the second punch means with the first punch means when the second punch means is connected to the first punch means; and actuator means for actuating the connecting and releasing means.

3. The improvement of claim 2 wherein the connecting and releasing means includes (a) a connector member defining a second-punch pathway for the second punch means, the connector member connected to the first punch means for movement therewith, (b) said connector member further defining a key pathway extending into the second-punch pathway, (c) a second-punch-engaging key movable in the key pathway between a position limiting movement of the second punch means in relation to the second-punch pathway and thereby in relation to the connector member and the first punch means, and another position of non-limiting movement of the second punch means relative to the second-punch pathway and thereby relative to the connector member and the first punch means;

said actuator means constituting means for driving the second-punch-engaging key in the key pathway to and from said positions.

4. The improvement of claim 3 wherein the connecting and releasing means further includes (c) a retainer on the second punch means, (d) catch means mounted on the body, movable between a position of engaging the retainer and a second position of releasing the retainer;

said actuator means constituting means for driving the catch means in coordination with the driving of the key, such that the catch means is in the position engaging the retainer when the key is in the position of non-limiting movement of the second punch means.

5. The improvement of claim 4 wherein the connector member further includes a retainer slot, the slot defining an end in the direction of punch travel to engage the retainer and limit free movement of the retainer relative to the connector means during travel of the connector means and the punch means in the direction opposite the direction of punch travel.

6. The improvement of claim 5 wherein the connector member defines the key pathway such that the key pathway extends transversely to the direction of punch travel, and the second-punch-engaging key is slidable transversely in the key pathway to transmit the force of formation of the fastener by the second punch through the key, when the key is in the position limiting movement of the second punch means.

7. The improvement of claim 6 wherein the key is slidable behind the second punch means in the position limiting movement of the second punch means.

8. The improvement of claim 7 wherein the actuator means constitutes means for sliding the second-punch-engaging key in the key pathway to and from said positions.

9. The improvement of claim 8 wherein the actuator means includes linear drive means for sliding the key in one direction of travel, and guide means for guiding the key for movement in the opposite direction of travel of the key during retraction of the first and second punch means.

10. The improvement of claim 9 wherein the catch means is mounted on the body to be pivotable between the position of engaging the retainer and the second position of releasing the retainer, and wherein the linear means for sliding the key is also linear means for pivoting the catch means.

11. The improvement of claim 9 wherein the guide means comprises a guiding member on the linear means and a cooperative guided member on the key, the guided member docking against the guiding member when the second punch means in retracted, whereby the guided member is guided while docked.

12. Apparatus for attachment of generally U-shaped metal clips about gathered material, said apparatus comprising:

a body, defining a first clip channel in the body and a second clip channel in the body substantially parallel to the first clip channel;

means for feeding clips seriatim into the first clip channel;

means for feeding clips seriatim into the second clip channel;

a first anvil supported by the body at one end of the first clip channel for forming a clip driven in the first clip channel about gathered material adjacent the anvil in the pathway of the clip driven in the first clip channel;

a second anvil supported by the body at one end of the second channel for forming a clip driven in the second channel about the gathered material adjacent the second anvil in the pathway of the gathered material driven in the second channel;

a first punch reciprocally mounted in the first clip channel and movable therein for engaging and driving a clip in the first clip channel;

a second punch reciprocally mounted in the second clip channel and movable therein for engaging and driving a clip in the second clip channel, the second punch including a punch retaining pin;

fluid drive means supported on the body and connected to the first punch for driving the first punch in the first clip channel and connected to the second punch for driving the second punch in the second clip channel;

a block member having a through passage for the second punch, the block member connected to the first punch;

a catch mounted on the body, pivotal between a retaining pin engaging position and a second non-engaging position, said block member further including a retaining pin slot opening into the through passage, the slot defining an end in the direction of punch travel to engage the pin and limit free movement of the pin therethrough the slot, said block further including a transverse passage extending into the through passage;

a second punch engaging key slidable in the transverse passage between a first position limiting movement of the second punch in the through passage, and a second position of non-interference with the through passage;

a linear actuator for sliding the key between the first position and the second position and for pivoting the catch between non-engaged position and the engaged position; and a guiding member on the linear actuator and a cooperative guided member on the key, the guided member docking against the guiding member when the second punch means is retracted, whereby the guided member is guided while docked;

whereby both punches operate simultaneously when the key is in the first position limiting movement of the second punch relative to the block member and the catch is in the non-engaged position, and whereby the first punch operates while the second punch is inoperative when the key is in the second position and the catch is in the engaged position.

* * * * *